United States Patent [19]

Spiegel

[11] 3,941,139

[45] Mar. 2, 1976

[54] DISHWASHER SPRAY ASSEMBLY WITH INTERMITTENTLY OPERATING NOZZLES

[75] Inventor: Raymond William Spiegel, Stevensville, Mich.

[73] Assignee: Whirlpool Corporation, Benton Harbor, Mich.

[22] Filed: Aug. 15, 1974

[21] Appl. No.: 497,816

[52] U.S. Cl. ..... 134/176; 239/251

[51] Int. Cl.[2] ..... B08B 3/02

[58] Field of Search ..... 134/176, 179; 239/251

[56] References Cited

UNITED STATES PATENTS

| | | | |
|---|---|---|---|
| 3,160,164 | 12/1964 | Constance et al. | 134/176 |
| 3,253,784 | 5/1966 | Long et al. | 134/176 UX |
| 3,288,155 | 11/1966 | Swetnam | 134/176 |
| 3,447,752 | 6/1969 | Hardy | 239/251 |
| 3,590,863 | 7/1971 | Faust et al. | 134/176 X |
| 3,605,770 | 9/1971 | Robandt et al. | 134/179 |
| 3,797,509 | 3/1974 | Fukuzawa et al. | 134/179 X |

FOREIGN PATENTS OR APPLICATIONS

| | | | |
|---|---|---|---|
| 1,171,635 | 11/1969 | United Kingdom | 239/251 |

*Primary Examiner*—Robert L. Bleutge

*Attorney, Agent, or Firm*—Hill, Gross, Simpson, Van Santen, Steadman, Chiara & Simpson

[57] ABSTRACT

A spray assembly having at least one intermittently operating nozzle which comprises a spray device rotatably mounted on a pressurized water source within a washing chamber of a dishwashing appliance and having at least one nozzle thereon in isolated fluid communication with the water source so as to be operative only during select portions of a revolution of the spray device about the water source.

11 Claims, 5 Drawing Figures

DISHWASHER SPRAY ASSEMBLY WITH INTERMITTENTLY OPERATING NOZZLES

BACKGROUND OF THE INVENTION

1. Field of the Invention

The present invention relates to dishwashing appliances and somewhat more particularly to spray devices having intermittently operating spray nozzles in such appliances.

2. Prior Art

Dishwashing appliances having rotatable spray devices located in operative relation with dish-supporting racks and which include nozzles for directing water from within the spray devices against dishes, pots, pans, silverware, etc. in the racks within the washing chamber of the appliance are known.

Generally, every nozzle on a spray device is oriented to provide a predetermined spray pattern and at least one nozzle on such a spray device is oriented for directing washing liquid against a silverware basket mounted adjacent the door of a dishwashing appliance. However, since the spray device rotates 360° and the silverware basket occupies an area encompassed by about one-quarter revolution, the silverware washing nozzle directs its water against the washing chamber walls for about three-quarters of a revolution and does not materially contribute to the washing of dishes, etc. within the washing chamber. In addition, dishes, etc. located in corners or other isolated areas of a washing chamber having washing liquid distributed over them only at periodic portions of a revolution by a spray device and at other portions of the revolution are not being sufficiently washed.

Some attempts have been made by the prior art to achieve a somewhat improved water distribution by spray arm nozzles onto dishes in a washing chamber. For example, U.S. Pat. Nos. 3,160,164 and 3,447,752 disclose relatively complex apparatuses for periodically reversing the direction of rotation of a spray device by selectively channeling the flow of washing liquid through the spray device via various mechanical means. However, these devices, aside from their complexity and cost, still have a portion of the washing liquid directed against washing chamber walls and not materially contributing to washing of silverware, isolated dishes, etc. within the chamber.

In addition, various lawn sprinkling apparatuses are known which include means for selectively varying the water distribution pattern. For example, U.S. Pat. No. 3,104,818 discloses a lawn sprinkler having a manifold which may be indexed to various positions for controlling the supply of water to various parts of the sprinkler and thus effecting the water distribution pattern. Lawn sprinklers are quite different from dishwashing appliances and fail to provide intermittently operating nozzles.

SUMMARY OF THE INVENTION

The invention provides a dishwasher appliance which includes a unidirectionally rotatable spray device in communication with a pressurized source of washing liquid and a plurality of nozzles thereon for directing the wash liquid throughout the washing chamber of the appliance with at least one of such nozzles being isolated from the plurality of nozzles so as to be operational only during a predetermined portion of each revolution of the spray device.

The invention accomplishes these and other features by associating a fluid-isolated nozzle with a unidirectionally reaction-type spray device so that the isolated nozzle is operative only during a predetermined portion of each revolution of the spray device.

In certain embodiments of the invention, a reaction-type spray device is rotatably mounted on a source of pressurized washing liquid and includes a plurality of nozzles thereon for distributing the washing liquid throughout a washing chamber of a dishwashing appliance, with at least one of such nozzles being fluid-isolated from the other nozzles and having a means for selectively providing fluid communication between the isolated nozzle and the source of pressurized washing liquid as the spray device rotates continuously in one direction so that such fluid-isolated nozzle is only intermittently supplied with washing liquid while the other nozzles are continuously supplied with washing liquid.

In certain preferred embodiments of the invention, a source of pressurized water includes a conduit having apertured side walls with the spray device rotatably mounted on the conduit adjacent the apertures so that there is fluid communication between the spray device and the conduit and at least one of the nozzles on the spray device is connected to a tubular member carried by the spray device so that the tubular member has one end thereof in fluid communication with the nozzle and has another end thereof positioned adjacent and openly facing the apertured side walls of the conduit so that during operation, the tubular member end adjacent the apertured side walls of the conduit is exposed to said aperture only during a portion of each revolution of the spray device about the conduit.

DESCRIPTION OF THE PREFERRED EMBODIMENTS

Figure 1:
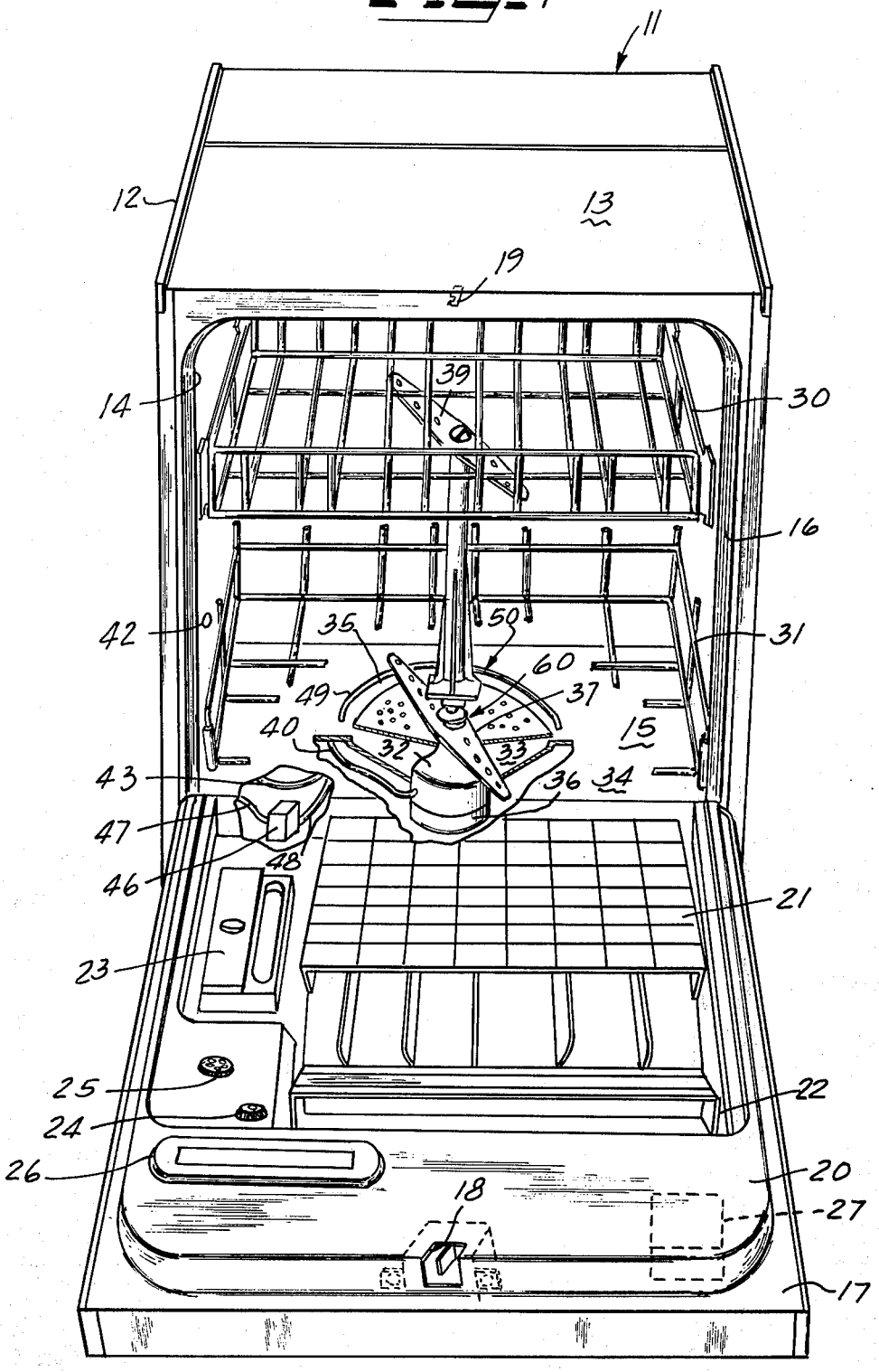
FIG. 1 illustrates a front-loading dishwashing appliance with portions broken away for illustration and which may include certain embodiments of the invention.

The principles of the invention will be described in relation to a two-rack portable dishwashing appliance, such as a front-loading dishwashing machine generally indicated at 11 in FIG. 1.

The front-loading dishwasher 11 has a cabinet 12 with a top 13. The cabinet 12 is provided with an opening 14 on one side which allows entry into the washing chamber or enclosure 15. To close the opening 14, a closure, such as a hollow door 17, is pivotally connected to one side of the opening and is movable from the position illustrated to a position closing the opening. The opening 14 is provided with a seal or gasket 16, which extends around the periphery of the sides and top of the opening. The door 17 is provided with a latching mechanism 18, which coacts with a striker 19 disposed at an edge of the opening 14 for latching the door in the closed position during which aan inner panel 20 of the door 17 tightly engages the gasket 16 to provide a sealing position which prevents leakage of water from the chamber 15.

As illustrated, the inner panel 20 of the door 17 has mounted thereon silverware baskets 21 and 22, a detergent dispenser 23, a rinse additive dispenser which has a filling cap 24 and a discharge opening 25, along with a vent opening 26 which allows hot humid air to escape from the chamber 15 during a drying cycle. Mounted in the hollow door 17 beneath the panel 20 is a timer 27 which is utilized to control various cycles of the washing, draining or rinsing and drying along with dispensing of the detergent and dispensing of the rinse additive.

Within the washing chamber 15 are mounted dish-supporting racks 30 and 31. To provide a spray of wash liquid and rinse liquid to the dishes in the racks 30 and 31, a pump 32 is disposed in a recess or depressed sump area 33 in a bottom wall 34 of the chamber 15. To remove food particles from the liquid prior to being circulated by the pump 32, the sump 33 is provided with a filter screen 35. The pump 32, which is driven by a motor 36, has two pump chambers (not shown), one of which provides wash liquid under pressure to a lower spray device 37 and through a hub assembly 60 to a water distribution means 50, which has an upper spray device 39 mounted thereon. The other pump chamber of pump 32, pumps the wash liquid during a drain-out or pump-out portion of the cycle through a discharge conduit 40 which is connected to a suitable discharge conduit of the dishwasher 11. Washing liquid enters the washing chamber 15 through an inlet opening 42 which is connected by a hose or conduit 43 to an inlet water system for the dishwasher 11, which system delivers water under pressure from a source of water under pressure, such as a household faucet or the like. A control or valve means 46 disposed in a fluid line formed by a pair of conduits 47 and 48 controls the discharge of fluid in the chamber 15. Conduit 47 is connected to the inlet opening 42. A heating element 49, of the sheathed electrical resistance type, is provided in the chamber 15 to heat the washing liquid during the wash cycle and to heat the air during a drying cycle.

In dishwashers which include more than one spray device, such as the one illustrated at FIG. 1, a water distribution system is required for providing wash liquid to the various spray devices. The water distribution system or apparatus 50 may be of various constructions which enable pressurized washing liquid to be piped efficiently to a lower spray device 37 and upwardly to an upper spray device 39 for distribution over dishes, etc. in racks 31 and 30, respectively. A preferred water distribution construction is disclosed and claimed by W. W. Jarvis, Jr. et al in a co-pending application, U.S. Ser. No. 494,893, filed Aug. 5, 1974, assigned to the instant assignee and which is incorporated herein by reference. Generally, the preferred apparatus for supplying wash liquid to a spray device located above a rack for supporting dishes within a washing chamber of a dishwashing machine as disclosed in the above application comprises a hollow tower vertically disposed with respect to the rack and which has an open lower end fixedly attached to the rack and an apertured upper end. A means for rotatably mounting a spray device is provided on the apertured upper end of the tower so that there is fluid communication between the tower and the spray device. A source of pressurized wash liquid is disposed below the open lower end of the tower and an open stationary hub assembly is fixedly mounted on the source of pressurized wash liquid and has an upper opening coaxially aligned with the lower end of the tower. An expansible non-rotating coupling member is fixedly mounted on the hub assembly and is open at opposite ends thereof for fluid communication therethrough so that the upper opening thereof is below and substantially concentric with the open lower end of the tower. As pressurized wash liquid flows from its source through the hub assembly into the coupling member, it expands the coupling member into sealing contact with the lower end of the tower. Wash liquid is thus piped directly from its source through the tower and into the spray device. Further details are available in the above W. W. Jarvis, Jr. et al patent application.

Figure 2:
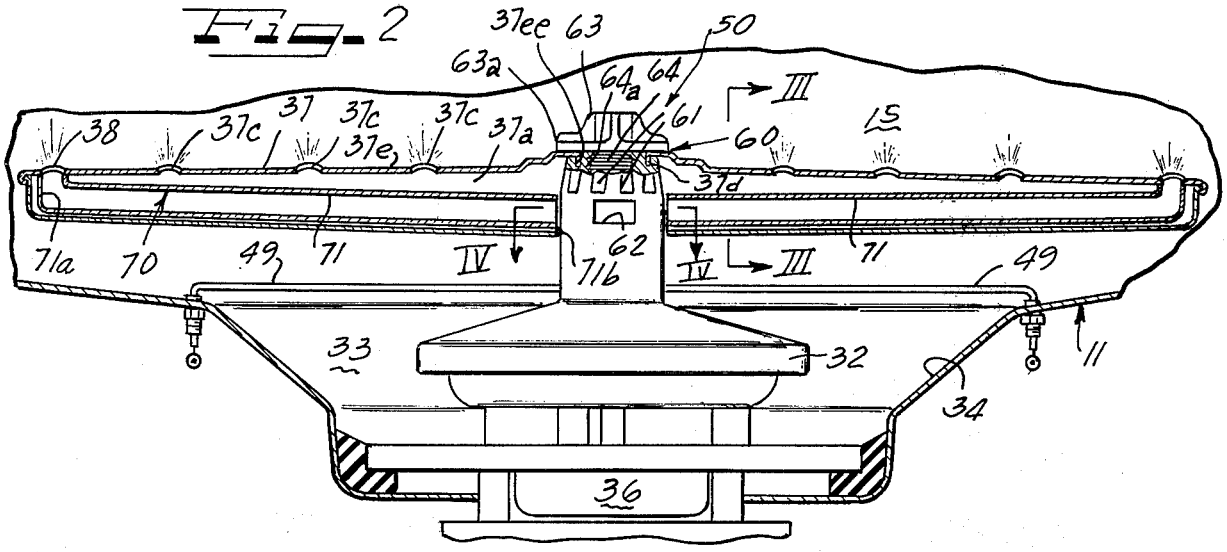
FIG. 2 is a partial cross-sectional view, with portions in elevation, of an embodiment of the invention mounted within a dishwashing appliance.

Another preferred water distribution system **50*a* is generally illustrated at FIG. 2** and is somewhat similar to that disclosed by I. G. Dutcher in U.S. Pat. No. 3,370,869, which is assigned to the instant assignee and is incorporated herein by reference. Generally, this system comprises a means for receiving pressurized washing liquid and directing a portion thereof into one spray device and converting another portion thereof into a jet-like stream which is directed upwardly into a suitably mounted spray device located above the receiving means. Further details are available in the above Dutcher patent.

In certain dishwashing appliances, only a single spray device, such as 37 or 39 of FIG. 1 is utilized and the principles of the invention are also applicable to such appliances. Further, since the spray devices are essentially identical in construction, the specific construction of only a single spray device will be provided.

FIG. 2 illustrates a portion of a dishwasher 11 having a source of pressurized wash liquid, such as a pump 32. A hub assembly 60 is fixedly mounted on an outlet of pump 32 or on a conduit connected to such an outlet. The hub assembly 60 is open at both ends thereof and has a plurality of apertures 61 and 62 along side walls thereof. It will be noted that in the exemplary embodiment shown, the apertures 61 are spaced from aperture 62 and are more or less uniformly distributed about the peripheral side wall of hub assembly 60 while aperture 62 encompasses only a select area of the peripheral side walls of hub assembly 60. However, in other embodiments other aperture arrangements may be used.

A hollow spray device 37, preferably of the reaction type, is rotatably mounted onto the hub assembly 60. The upper surface **37*e* of spray device 37 carries a plurality of nozzles 37*c*' as well as at least one isolated nozzle 38. The location of isolated nozzle 38 may be selected in accordance with a desired water distribution pattern. When an isolated nozzle, such as 38, is located in the position shown, it will be operative only during that portion of a revolution of the spray device which carries the isolated nozzle past a silverware basket, such as 21, mounted on a door 17 of dishwasher 11.** The fluid isolation of a select nozzle insures that it receives pressurized wash liquid only during a portion of each complete revolution of the spray device such as when the spray device is traversing a select angle, such as the angle $\alpha$while the remaining nozzles of the spray device receive pressurized wash liquid throughout the entire revolution of the spray device about the hub assembly. If desired, more than one select angle may be utilized and more than one nozzle may be isolated in accordance with the principles of the invention. Thus, the invention allows one to selectively activate one or more nozzles on a spray device throughout a given revolution thereof so as to achieve an even spray pattern throughout a washing chamber or to concentrate the spray pattern in a particular area within the chamber.

The radially inner ends of spray device upper surface 37*e* are provided with down-turned flanges 37*ee* which loosely fit within the open upper end of hub assembly 60. A nozzle cap 63 is threadingly attached, as along threads 64*a* to a jet nozzle member 64, which forms a part of hub assembly 60. The nozzle cap 63 includes radially outwardly extending lower shoulder 63*a* which in assembly abut against areas of upper surface 37*e* which are adjacent flanges 37*ee* thereby maintaining the spray device 37 onto the hub assembly 60.

Figure 3:
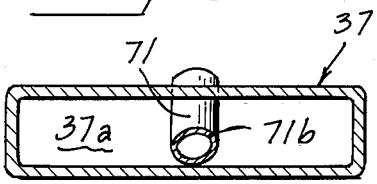
FIG. 3 is a partial sectional view taken along lines III—III of FIG. 2.
Figure 5:
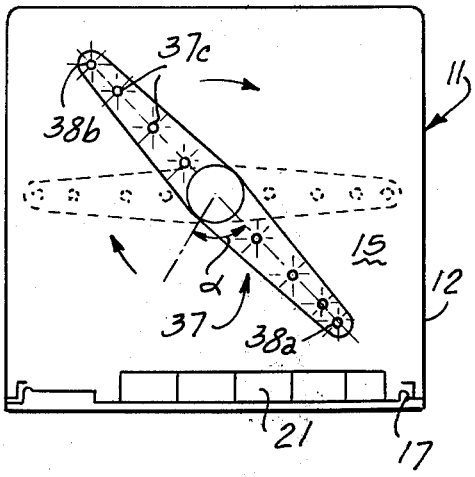
FIG. 5 is a schematic view, with portions omitted, of a spray device mounted within a washing chamber and which is useful in explaining certain aspects of the invention.

The spray device 37 comprises a hollow chamber 37*a* having peripheral side walls for containing a wash liquid and having a planar shape generally shown at FIG. 5. A means 70 is provided within chamber 37*a* for isolating a select nozzle, such as 38, from the plurality of nozzles carried by spray device 37. In a preferred embodiment, means 70 comprise at least one elongated tube-like member 71 which has an outer end 71*a* in fluid communication with nozzle 38 and an inner end 71*b* adjacent and openly facing the side wall of hub assembly 60 along a portion thereof which contains aperture 62. As best seen in FIG. 3, the tube-like member 71 occupies a relatively small area within chamber 37*a*.

The aperture 62 is aligned in relation with the washing chamber so that an angle defined by the lateral edges of aperture 62 and the axial center of hub assembly 60 encompasses an area within the washing chamber which is to receive the spray of the isolated nozzle. In certain embodiments of the invention, aperture 62 is aligned with the silverware basket so that the fluid isolated nozzle is operative only when the nozzle passes the silverware basket.

Figure 4:
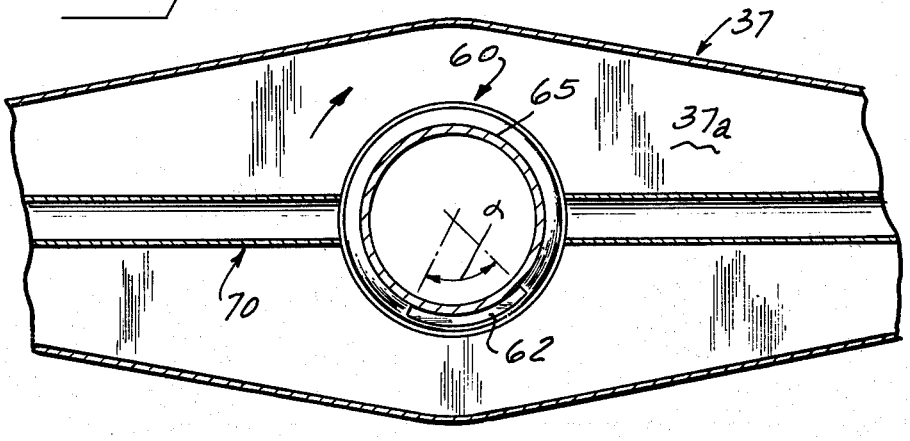
FIG. 4 is a partial top sectional view taken along lines IV—IV of FIG. 2.

In operation, as pressurized wash liquid is forced upwardly by pump 32, it flows through the hub assembly 60, with a portion thereof exiting through the upper portion of nozzle cap 63 and the remaining portion exiting into chamber 37*a* via apertures 61 and 62. The pressurized wash liquid which exits through aperture 61 flows within chamber 37*a* and is continuously distributed by nozzles 37*c* in a pattern within washing chamber 15. The pressurized wash liquid which exits through aperture 62 flows within the tube-like member 71 and is distributed by nozzle 38 within chamber 15. Of course, pressurized wash liquid can only exit through aperture 62 when the aperture 62 is aligned with the inner end 71*b* of the tube-like member 71. Thus, as best seen at FIG. 4, the lateral extend of aperture 62 defines the angle $\alpha$ throughout which wash liquid is supplied to an isolated nozzle. Of course, the lateral dimensions of aperture 62 may be varied as desired for each isolated nozzle.

As shown in FIG. 5, the nozzles 37*c* continuously distribute wash liquid throughout a revolution of spray device 37. However, isolated nozzles 38*a* and 38*b* are inoperative for about three-quarters of a revolution and only operate in the revolution quadrant which encompasses the silverware basket 21. Thus, as nozzle 38*a* approaches basket 21, pressurized wash liquid begins flowing through means 70 and is distributed against the right-hand portion of basket 21. Nozzle 38*a* continues to operate as it travels throughout the quadrant and as it passes the left-hand portion of basket 21, the inner end 71*b* of a tube-like member 71 passes beyond a lateral edge of aperture 62 and pressurized wash liquid is no longer able to exit through aperture 62. At this stage, both nozzles 38*a* and 38*b* are inoperative and then nozzle 38*b* approaches basket 21 and the above distribution cycle is resumed.

Although particular embodiments of the invention have been described and illustrated herein, it is recognized that modifications and variations may readily occur to those skilled in the art. For example, if desired, the tube-like member 71 may be integrally formed with a spray device such as 37 or may be separately formed and assembled into a single unit. Further, the size and relation of the apertures 61 and 62 in hub assembly 60 may be varied from that shown. Consequently, it is intended that the claims be interpreted to cover all such modifications and equivalents which fairly fall within the scope and spirit of the invention and as defined in the claims.

The embodiments of the invention in which an exclusive property or privilege is claimed are defined as follows:

1. A dishwashing machine having a washing chamber, at least one rack for supporting dishes within said chamber and apparatus for distributing wash liquid onto dishes within said rack, said apparatus comprising:

a pump means having an outlet positioned below said rack for supplying wash liquid under prssure within said chamber;

at least one hollow spray device rotatably mounted within said chamber in operative relation with said rack and in fluid communication with said outlet of the pump means;

means for continuously rotating said spray device in a unidirectional manner;

a plurality of nozzles carried by said spray device for providing fluid communication between said spray device and said washing chamber; and means for fluid-isolating at least one of said nozzles from the remainder of said plurality of nozzles and providing fluid communication between the isolated nozzle and the outlet of said pump means only during a select portion of each unidirectional revolution of said spray device as said spray device rotates about said outlet so that wash liquid is intermittently supplied to said one nozzle and continuously supplied to the remainder of said plurality of nozzles.

2. A dishwashing machine as defined in claim 1 wherein said means for fluid-isolating at least one of said nozzles from the remainder of said plurality of nozzles and providing fluid communication between said one of the nozzles and the outlet of the pump means includes a tube-like member having one end thereof connected to said one of the plurality of nozzles and another end thereof in operative relation with said outlet of the pump means so as to fluid-isolate said one nozzle from the remaining plurality of nozzles whereby wash liquid is intermittently supplied to said one nozzle and continuously supplied to the remainder of said plurality of nozzles.

3. A dishwashing machine having a washing chamber, a rack for supporting dishes within said chamber and apparatus for spraying wash liquid onto dishes within said rack, said apparatus comprising:

a conduit within said washing chamber positioned below said rack and having a plurality of apertures along a peripheral side wall of said conduit, at least one of said plurality of apertures being axially spaced from the remaining plurality of apertures;

a pump means associated with said conduit for supplying washing liquid under pressure through said conduit;

a hollow spray device rotatably mounted on said conduit adjacent said plurality of apertures so as to provide fluid communication between said conduit and said hollow spray device;

a plurality of nozzles carried by said spray device for providing fluid communication between said spray device and said washing chamber;

means for continuously rotating said spray device unidirectionally; and means for fluid-isolating at least one of said nozzles from the remaining plurality of nozzles and providing fluid communication between said fluid-isolated nozzles and said one axially spaced aperture of the conduit so as to provide select fluid communication between said one nozzle and said conduit as said spray device unidirectionally rotates about said conduit so that wash liquid is intermittently supplied to said fluid-isolated nozzles and continuously supplied to the remainder of said plurality of nozzles.

4. A dishwashing machine as defined in claim 3 wherein said means for fluid-isolating at least one of said nozzles from the remaining plurality of nozzles includes a tube-like member carried by said spray device;

said tube-like member having one end in fluid communication with said one fluid-isolated nozzle and another end thereof adjacent and openly facing said one axially spaced aperture of the conduit;

said other end of the tube-like member being exposed to said one axially spaced aperture of the conduit during only a portion of the tube-like member path of travel as said spray device unidirectionally rotates, whereby said tube-like member is in fluid communication with said conduit only when said other end of the tube-like member passes before said one axially spaced aperture of the conduit.

5. A dishwashing machine as defined in claim 3 wherein said conduit includes at least two separate apertures in a side wall of said conduit, said apertures being axially spaced from each other so that one of said apertures is in fluid communication with said one nozzle and the other of said apertures is in fluid communication with said remaining plurality of nozzles.

6. A dishwashing machine having a washing chamber, at least one rack for supporting dishes within said chamber and an apparatus for distributing wash liquid onto dishes within said rack, said apparatus comprising:

a pump means having an outlet positioned below said rack for supporting wash liquid under pressure within said chamber;

said outlet including a plurality of apertures along side walls thereof and at least two of said apertures being axially spaced from one another;

at least one hollow spray device rotatably mounted within said chamber in operative relation with said rack and in fluid communication with said outlet;

a plurality of nozzles carried by said spray device for providing fluid communication between said spray device and said washing chamber; and at least one tube-like member mounted within said spray device having an outer end thereof in fluid communication with a select one of said plurality of nozzles and having an inner end thereof adjacent and openly facing said outlet side walls along a portion thereof encompassing only one of the axially spaced apertures therein; whereby said tubular member is in fluid communication with said outlet only when said inner end of the tube-like member passes before the encompassed aperture as said spray device rotates about said outlet.

7. A dishwashing machine as defined in claim 6 which includes a silverware basket mounted on a closure member of said machine and the encompassed aperture has lateral peripheral boundaries which define with the axial center of said outlet an angle encompassing an area within said washing chamber corresponding to that occupied by said basket.

8. A dishwashing machine as defined in claim 7 wherein said encompassed aperture is aligned with said silverware basket so that the select one of said plurality of nozzles operates only when the select nozzle passes said silverware basket.

9. In a dishwashing appliance, means forming a treatment zone for receiving articles to be washed in separate areas within said zone;

means including conduit means for pressurizing a supply of washing liquid and driving said supply of washing liquid in the form of a stream;

a rotatable spray device having a plurality of passage means formed therein including at least one passage which has an opening inlet end at the radially innermost end thereof;

hub means selectively interconnecting said spray device and said conduit means and having a first plurality of circumferentially spaced openings for intermittent registration with said open inlet end of the one passage within the spray device, whereby the pressurized stream intermittently directs a supply of washing liquid to a select one of said separate areas in said zone via said one passage within the spray device and continuously directs a supply of washing liquid to the remainder of said separate areas; and means for continuously rotating said spray device in one direction only during the operation of the dishwashing appliance.

10. In a dishwashing appliance as defined in claim 9 wherein said plurality of passage means within the spray device includes other passages formed with open inlet ends at the radially innermost end thereof but spaced axially and separate from said open inlet end of the one passage within said spray device; and said hub means includes a second plurality of circumferentially spaced openings axially spaced from said first plurality of openings therein, said second plurality of circumferentially spaced openings being disposed in continuous register with said open inlet ends of said other passages.

11. In a dishwashing appliance as defined in claim 9 wherein said means for continuously rotating said spray device in one direction only comprises reaction spray nozzles fed by said passage means.

* * * * *